US012196470B2

(12) United States Patent
Swallow et al.

(10) Patent No.: US 12,196,470 B2
(45) Date of Patent: Jan. 14, 2025

(54) SYSTEMS AND METHODS FOR DETERMINING STARTUP PRESSURE RATIO FOR DYNAMIC COMPRESSORS

(71) Applicant: Emerson Climate Technologies, Inc., Sidney, OH (US)

(72) Inventors: Matthew J. Swallow, Versailles, OH (US); Michael M. Perevozchikov, Tipp City, OH (US)

(73) Assignee: Copeland LP, Sidney, OH (US)

( * ) Notice: Subject to any disclaimer, the term of this patent is extended or adjusted under 35 U.S.C. 154(b) by 293 days.

(21) Appl. No.: 17/804,317

(22) Filed: May 27, 2022

(65) Prior Publication Data

US 2023/0384012 A1 Nov. 30, 2023

(51) Int. Cl.

| | |
|---|---|
| ***F25B 49/02*** | (2006.01) |
| ***F04D 17/10*** | (2006.01) |
| ***F04D 27/02*** | (2006.01) |

(52) U.S. Cl.

CPC ..... *F25B 49/022* (2013.01); *F04D 17/10* (2013.01); *F04D 27/02* (2013.01);
(Continued)

(58) Field of Classification Search

CPC ..... F25B 49/022; F25B 2500/18; F25B 2500/19; F25B 2500/26; F25B 2600/01; F25B 2600/025; F25B 2600/0253; F25B 2700/1931; F25B 2700/1933; F25B 2700/195; F25B 2700/197;
(Continued)

(56) References Cited

U.S. PATENT DOCUMENTS 5,306,116 A 4/1994 Gunn et al.
5,709,526 A 1/1998 McLeister et al.
(Continued)

FOREIGN PATENT DOCUMENTS

JP 2005009734 A * 1/2005 ..... F25B 49/022
JP 2012052719 A 3/2012
(Continued)

OTHER PUBLICATIONS

International Search Report and Written Opinion issued by the International Searching Authority in PCT/US2023/022838 mailed on Sep. 6, 2023, 13 pgs.

*Primary Examiner* — Jerry-Daryl Fletcher
*Assistant Examiner* — Daniel C Comings
(74) *Attorney, Agent, or Firm* — Armstrong Teasdale LLP

(57) ABSTRACT

A controller for a system having an evaporator, a condenser, and a dynamic compressor includes a processor and a memory, which stores instructions that program the processor to determine a first heat transfer fluid temperature at a first heat transfer fluid path of the evaporator, determine a first pressure at a first working fluid path based on the first heat transfer fluid temperature, determine a second heat transfer fluid temperature at a second heat transfer fluid path of the condenser, determine a second pressure at a second working fluid path based on the second heat transfer fluid temperature, calculate a pressure ratio of the compressor from the first and second pressures, determine a speed setpoint of the compressor based on the pressure ratio, and operate the compressor at the speed setpoint to compress a working fluid until a condition is met.

18 Claims, 9 Drawing Sheets

(52) U.S. Cl.
CPC ... *F25B 2500/19* (2013.01); *F25B 2600/0253* (2013.01); *F25B 2700/1931* (2013.01); *F25B 2700/1933* (2013.01); *F25B 2700/195* (2013.01); *F25B 2700/197* (2013.01); *F25B 2700/21161* (2013.01); *F25B 2700/21171* (2013.01)

(58) Field of Classification Search
CPC .. F25B 2700/21161; F25B 2700/21175; F25B 2700/21173
See application file for complete search history.

(56) References Cited

U.S. PATENT DOCUMENTS

| | | | | |
|---|---|---|---|---|
| 6,308,523 | B1 * | 10/2001 | Scaringe | F25B 49/005 235/487 |
| 7,007,472 | B2 | 3/2006 | Baize et al. | |
| 8,840,358 | B2 | 9/2014 | Huis In Het Veld | |
| 9,255,580 | B2 | 2/2016 | Waugh et al. | |
| 9,328,949 | B2 | 5/2016 | Blaiklock et al. | |
| 9,702,365 | B2 | 7/2017 | Rosinski et al. | |
| 9,816,742 | B2 | 11/2017 | Rite et al. | |
| 10,047,759 | B2 | 8/2018 | Kundig et al. | |
| 10,428,677 | B2 | 10/2019 | Muric et al. | |
| 10,677,149 | B2 | 6/2020 | Sase et al. | |
| 10,989,210 | B2 | 4/2021 | Swindlehurst et al. | |
| 2003/0182950 | A1 * | 10/2003 | Mei | F25B 49/005 62/129 |
| 2004/0237552 | A1 * | 12/2004 | Yamasaki | F25B 49/025 62/229 |
| 2005/0132705 | A1 | 6/2005 | Boley et al. | |
| 2010/0017540 | A1 | 1/2010 | Okabayashi et al. | |
| 2016/0047392 | A1 | 2/2016 | Bernocchi et al. | |
| 2022/0065513 | A1 | 3/2022 | Oakley et al. | |

FOREIGN PATENT DOCUMENTS

| | | | | |
|---|---|---|---|---|
| JP | 2013083424 | A | 5/2013 | |
| KR | 101689724 | B1 * | 12/2016 | F24F 11/02 |
| WO | WO-03072946 | A1 * | 9/2003 | F04D 25/06 |

* cited by examiner

SYSTEMS AND METHODS FOR DETERMINING STARTUP PRESSURE RATIO FOR DYNAMIC COMPRESSORS

FIELD OF THE DISCLOSURE

The field of the disclosure relates generally to control systems, and more particularly, to control systems for dynamic compressors.

BACKGROUND

Dynamic compressors, including centrifugal compressors, are commonly used in process industries and in heating, ventilation, and air conditioning (HVAC) systems. The compressor is operatively connected to a motor via a shaft that supports one or more compression stages. The motor rotates the compression stage(s) via the shaft at a rotational speed and loading condition selected to compress a refrigerant to a specified demand. The motor speed and load can be controlled to operate the compressor under a wide range of operating conditions. The operating range of the compressor is limited by regions of surge at low flow rates, and by regions of choke at high flow rates. Knowledge of the precise operating point of the system can help avoid operating the compressor in surge or choke and minimize the duration of the compressor's start-up routine.

The operating point of a dynamic compressor is determined in part by the compressor's speed, which can be controlled by a user, and by the pressure ratio across the compressor, which is a function of the compressor's speed and loading condition. However, it is difficult to accurately measure the pressure ratio of a dynamic compressor prior to a start-up routine, because a discharge check valve downstream of the dynamic compressor prevents high pressure refrigerant from flowing from a condenser to the compressor pressure sensor to be measured. Thus, there is a need for a system and method to determine the pressure ratio across the dynamic compressor at startup without the use of pressure measurements.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the disclosure is directed to a system including an evaporator, a condenser, and a dynamic compressor operable to compress a working fluid. The evaporator includes a first working fluid path and a first heat transfer fluid path thermally coupled thereto. The condenser includes a second working fluid path and a second heat transfer fluid path thermally coupled thereto. The dynamic compressor is fluidly coupled to the first working fluid path of the evaporator and the second working fluid path of the condenser. The system further includes a first temperature sensor positioned within the first heat transfer fluid path of the evaporator, and a second temperature sensor positioned within the second heat transfer fluid path of the condenser. The system additionally includes a controller connected to the dynamic compressor, which includes a processor and a memory. The memory stores instructions that program the processor to receive a command to begin operation of the compressor, receive a first heat transfer fluid temperature from the first temperature sensor, determine a first pressure at the first working fluid path of the evaporator based on the first heat transfer fluid temperature, receive a second heat transfer fluid temperature from the second temperature sensor, determine a second pressure at the second working fluid path of the condenser based on the second heat transfer fluid temperature, determine a pressure ratio of the dynamic compressor from the first and second pressures, determine a speed setpoint of the dynamic compressor based on the pressure ratio, and operate the dynamic compressor at the speed setpoint to compress to working fluid until a condition is met.

Another aspect of the present disclosure is directed to a controller for a system including an evaporator, a condenser, and a dynamic compressor fluidly coupled therebetween. The controller includes a processor and a memory. The memory stores instructions that program the processor to receive a command to begin operation of the dynamic compressor, determine a first heat transfer fluid temperature at a first heat transfer fluid path of the evaporator, determine a first pressure at a first working fluid path of the evaporator based on the first heat transfer fluid temperature, determine a second heat transfer fluid temperature at a second heat transfer fluid path of the condenser, determine a second pressure at a second working fluid path of the condenser based on the second heat transfer fluid temperature, calculate a pressure ratio of the dynamic compressor from the first and second pressures, determine a speed setpoint of the dynamic compressor based on the pressure ratio, and operate the dynamic compressor at the speed setpoint to compress a working fluid until a condition is met.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

For conciseness, examples will be described with respect to a centrifugal compressor. However, the methods and systems described herein may be applied to any suitable dynamic compressor. The operation of a dynamic compressor can be improved by limiting the time the compressor spends outside of a safe operating envelope during a start-up routine. A start-up pressure ratio of the compressor, representing the pressure rise between the compressor inlet and exit, can be estimated using temperature measurements from other cycle components. The estimated pressure ratio can then be used to determine a speed setpoint within the safe operating envelope of the compressor.

Figure 1:
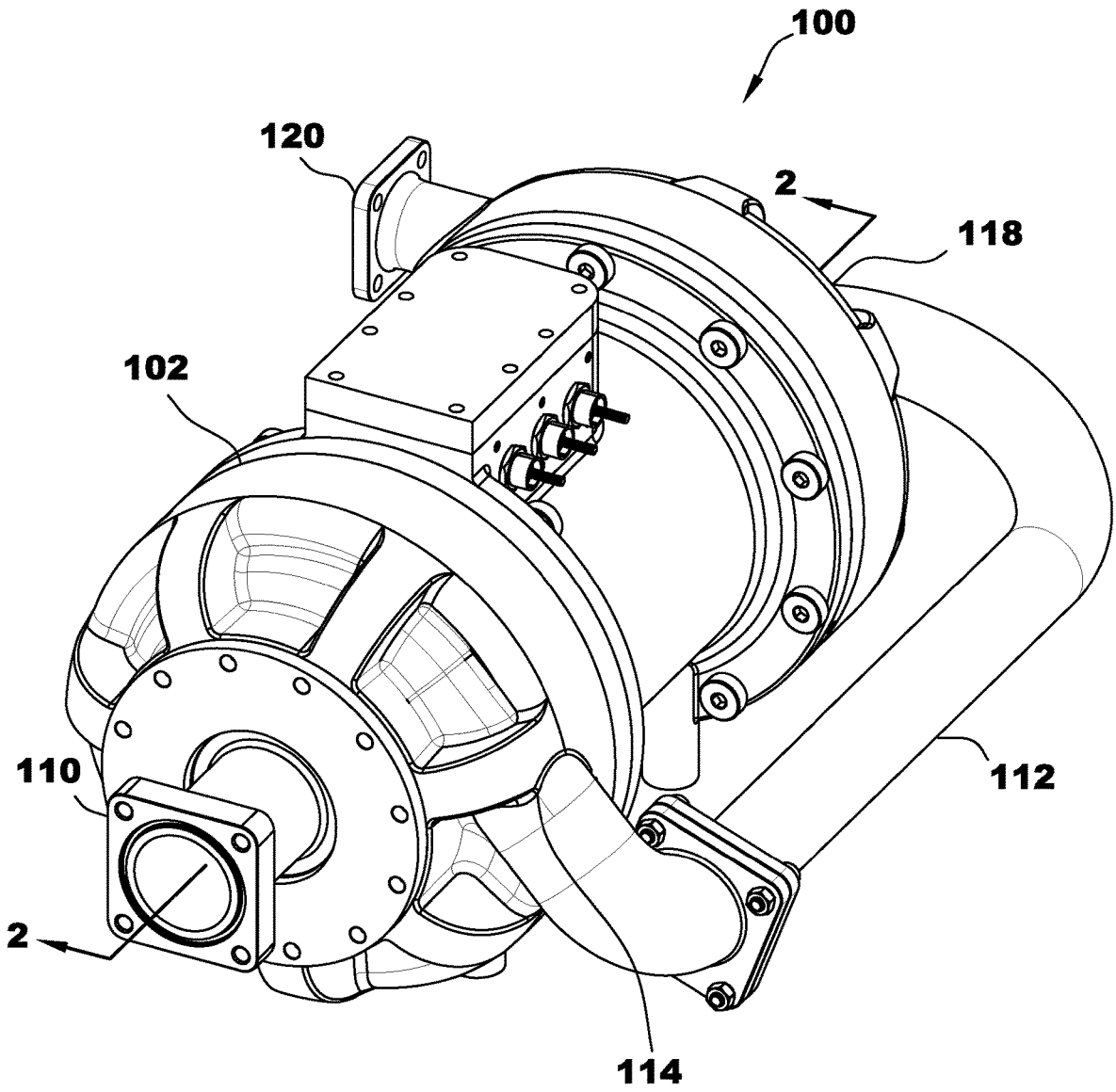
FIG. 1 is a perspective view of an assembled dynamic compressor.
Figure 3:
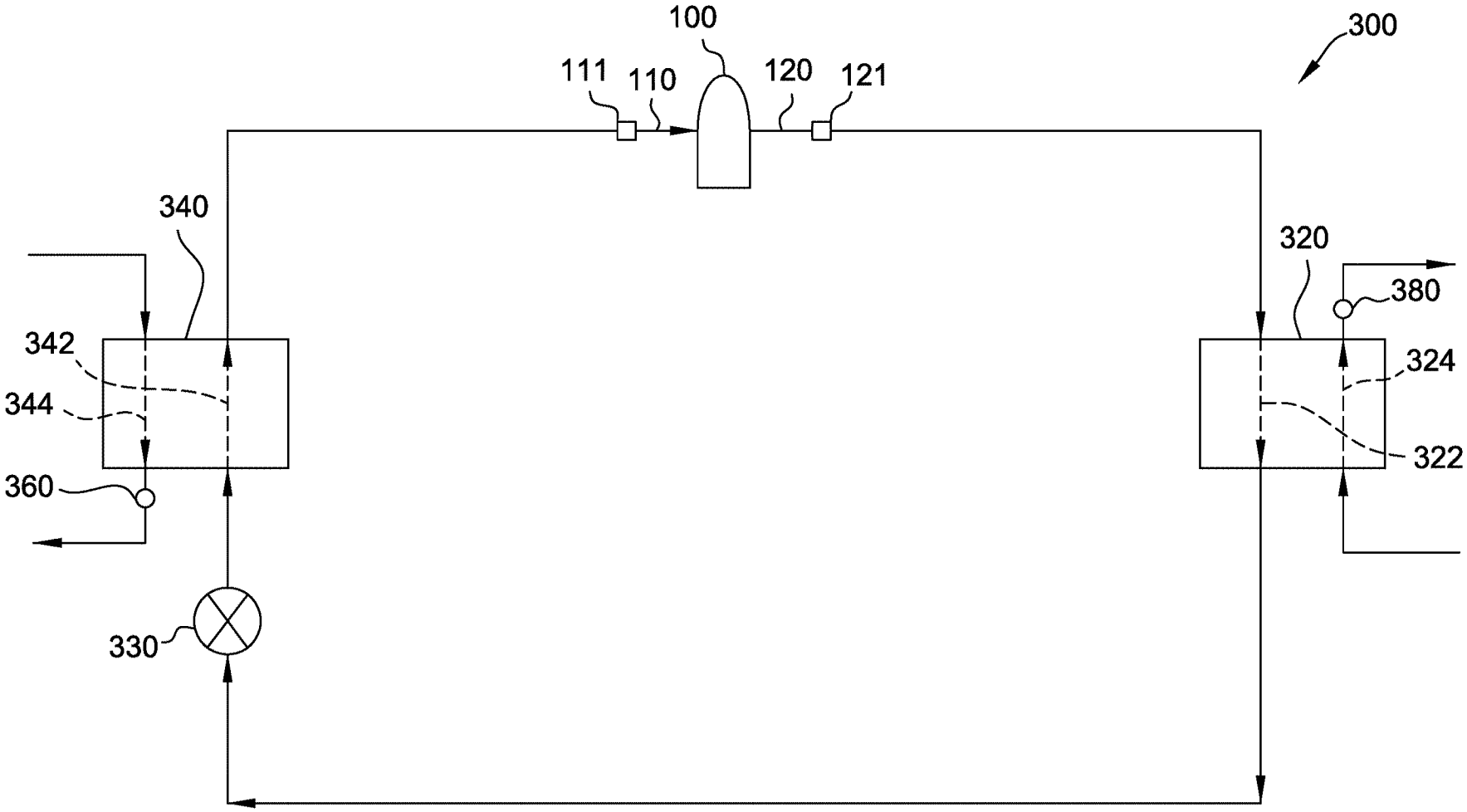
FIG. 3 is a schematic view of an example HVAC system in which the dynamic compressor shown in FIGS. 1 and 2 can be installed.

Referring to FIG. 1, a two-stage refrigerant compressor is indicated generally at 100. The dynamic compressor 100 is operable to compress a working fluid (e.g., refrigerant), and includes a compressor housing 102 that forms at least one sealed cavity within which each stage of refrigerant compression is accomplished. The dynamic compressor 100 includes a first refrigerant inlet 110 to introduce refrigerant vapor into a first compressor stage (not labeled in FIG. 1), a first refrigerant exit 114, a refrigerant transfer conduit 112 to transfer compressed refrigerant from the first compressor stage to a second compressor stage (not labeled in FIG. 1), a second refrigerant inlet 118 to introduce refrigerant vapor into the second compressor stage, and a second refrigerant exit 120. The refrigerant transfer conduit 112 is operatively connected at opposite ends to the first refrigerant exit 114 and the second refrigerant inlet 118, respectively. The second refrigerant exit 120 delivers compressed refrigerant from the second compressor stage to a cooling system in which compressor 100 is incorporated (FIG. 3).

Figure 2:
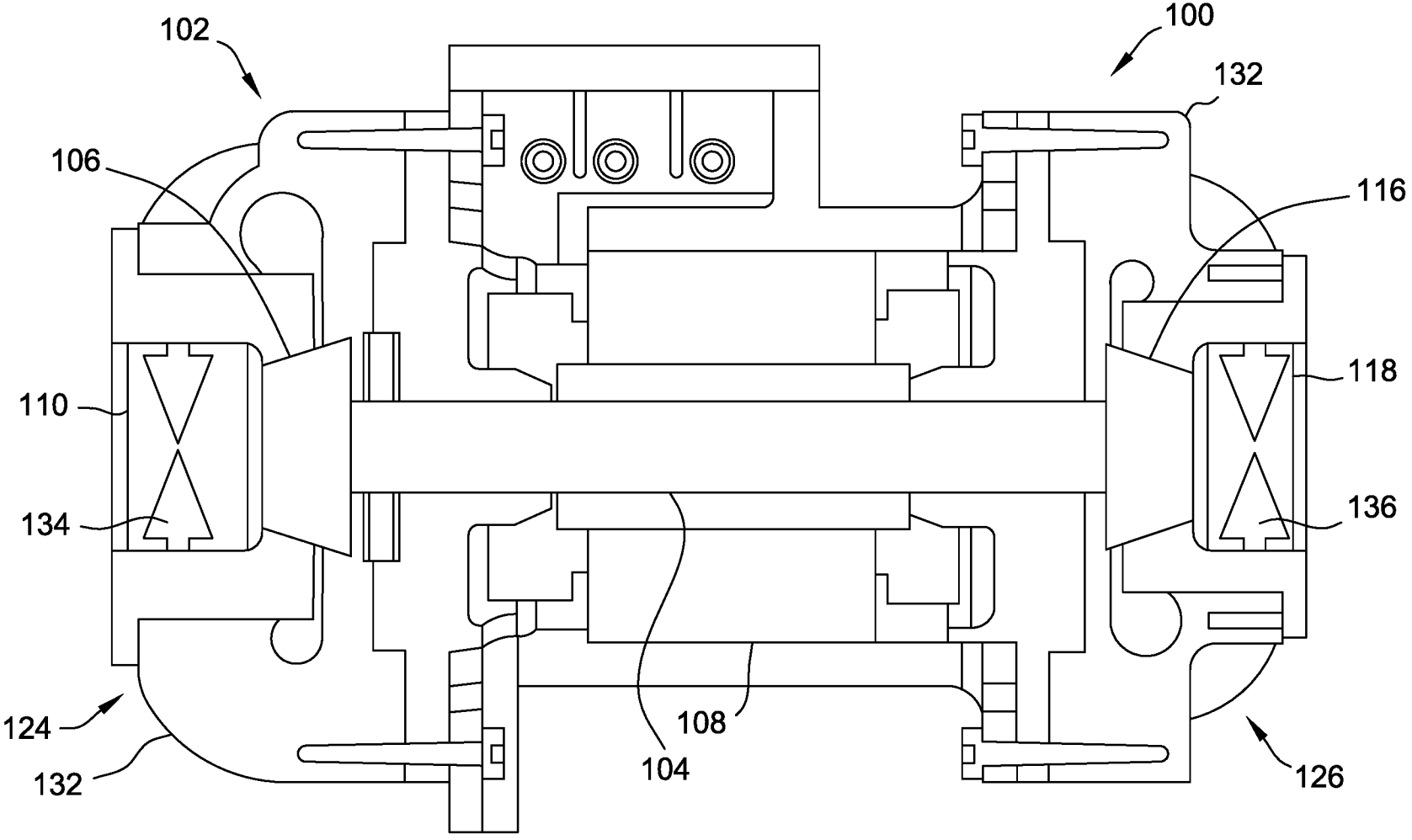
FIG. 2 is a cross-sectional view of the dynamic compressor of FIG. 1 taken along line 2-2 with the external conduit removed.

Referring to FIG. 2, the compressor housing 102 encloses the first compressor stage 124 and the second compressor stage 126 at opposite ends of the compressor 100. The first compressor stage 124 includes a first compression mechanism 106 configured to add kinetic energy to refrigerant entering via the first refrigerant inlet 110. In some embodiments, the first compression mechanism 106 is an impeller. The kinetic energy imparted to the refrigerant by the first compression mechanism 106 is converted to increased refrigerant pressure as the refrigerant velocity is slowed upon transfer to a sealed cavity (e.g., a diffuser) formed within the volute 132. The first compressor stage 124 additionally includes a first variable inlet guide vane (VIGV) 134 disposed upstream of the first compression mechanism 106 in the first refrigerant inlet 110. The first VIGV 134 includes a plurality of vanes whose position can be controlled to introduce pre-whirl into the gaseous refrigerant entering the first refrigerant inlet 110.

Similarly, the second compressor stage 126 includes a second compression mechanism 116 configured to add kinetic energy to refrigerant transferred from the first compressor stage 124 entering via the second refrigerant inlet 118. In some embodiments, the second compression mechanism 116 is an impeller. The kinetic energy imparted to the refrigerant by the second compression mechanism 116 is converted to increased refrigerant pressure as the refrigerant velocity is slowed upon transfer to a sealed cavity (e.g., a diffuser) formed within the volute 132. Compressed refrigerant exits the second compressor stage 126 via the second refrigerant exit 120 (not shown in FIG. 2). The second compressor stage 126 additionally includes a second variable inlet guide vane (VIGV) 136 disposed upstream of the second compression mechanism 116 in the second refrigerant inlet 118. The second VIGV 136 includes a plurality of vanes whose position can be controlled to introduce pre-whirl into the gaseous refrigerant entering the second refrigerant inlet 118.

The first compression mechanism 106 and second compression mechanism 116 are connected at opposite ends of a shaft 104. The shaft 104 is operatively connected to a motor 108 positioned between the first compression mechanism 106 and second compression mechanism 116 such that the first compression mechanism 106 and second compression mechanism 116 are rotated at a rotation speed selected to compress the refrigerant to a pre-selected pressure exiting the second refrigerant exit 120 (not shown in FIG. 2). Any suitable motor may be incorporated into the compressor 100 including, but not limited to, an electrical motor.

FIG. 3 is a schematic diagram of a first example HVAC system 300 in which the dynamic compressor 100 of FIGS. 1 and 2 may be installed. The system 300 has a single, closed refrigerant loop that includes the compressor 100, a condenser 320, a first expansion device 330, and an evaporator 340. Refrigerant enters the dynamic compressor 100 at the first refrigerant inlet 110 as a low-pressure, low-temperature gas. The dynamic compressor 100 adds kinetic energy to the refrigerant and converts it to pressure rise, and the refrigerant exits the dynamic compressor 100 at the second refrigerant exit 120 as a high-pressure, high-temperature gas. The dynamic compressor 100 may include at least one inlet pressure sensor 111 disposed proximate the first refrigerant inlet 110 for measuring the refrigerant pressure upstream of the dynamic compressor 100, and at least one exit pressure sensor 121 disposed proximate the second refrigerant exit 120 for measuring the refrigerant pressure downstream of the dynamic compressor 100.

The refrigerant then enters a second working fluid path 322 of the condenser 320, which is fluidly coupled to the second compressor stage 126 downstream thereof. The condenser 320 further includes a second heat transfer fluid path 324 thermally coupled to the second working fluid path 322. The second heat transfer fluid path 324 is configured to permit a heat transfer fluid to flow therethrough, and may form part of a secondary fluid loop (not shown). The heat transfer fluid may be water, glycol, refrigerant, air, or any suitable heat transfer fluid that allows the HVAC system 300 to function as described herein. The second working fluid path 322 and second heat transfer fluid path 324 allow the condenser 320 to function as a heat exchanger, with the heat transfer fluid absorbing heat from the refrigerant to convert the refrigerant gas into a high-pressure, high-temperature liquid. The heat transfer fluid may then reject heat into an exterior space (not shown).

The second working fluid path 322 of the condenser 320 is fluidly coupled to the first expansion device 330, which reduces the pressure of the refrigerant. In some embodiments, the pressure may be reduced until the liquid refrigerant's current temperature becomes the boiling point temperature at that pressure, and the refrigerant becomes a two-phase mixture as some of the liquid refrigerant boils and turns into a gas. The first expansion device 330 may be a fixed orifice, a thermal expansion valve, an electronic expansion valve, or any type of expansion device that allows the HVAC system 300 to function as described herein.

The first expansion device 330 is fluidly coupled to a first working fluid path 342 of the evaporator 340, which receives low-pressure, low-temperature liquid refrigerant or a two-phase mixture of liquid and gaseous refrigerant at its inlet.

The evaporator 340 further includes a first heat transfer fluid path 344 thermally coupled to the first working fluid path 342. The first heat transfer fluid path 344 is configured to permit a heat transfer fluid to flow therethrough, and may form part of a tertiary fluid loop (not shown). The heat transfer fluid may be water, glycol, refrigerant, or any suitable heat transfer fluid that allows the HVAC system 300 to function as described herein. The first working fluid path 342 and first heat transfer fluid path 344 allow the evaporator 340 to function as a heat exchanger. The heat transfer fluid in the first heat transfer fluid path 344 may absorb heat from a conditioned interior space or from an additional fluid loop (not shown). The refrigerant in the first working fluid path 342 absorbs heat from the first heat transfer fluid path 344 to change phase from a liquid to a gas. The first working fluid path 342 of the evaporator 340 is fluidly coupled to the first refrigerant inlet 110 upstream thereof, and the cycle begins again.

The system 300 includes a first temperature sensor 360 positioned within the first heat transfer fluid path 344 of the evaporator 340. In the embodiment illustrated in FIG. 3, the first temperature sensor 360 is positioned proximate an exit of the first heat transfer fluid path 344 of the evaporator 340, but the first temperature sensor 360 may be positioned at any suitable location upstream, for example and without limitation, proximate an inlet of the first heat transfer fluid path 344 of the evaporator 340, or within the first heat transfer fluid path 344 itself. The system 300 further includes a second temperature sensor 380 positioned within the second heat transfer fluid path 324 of the condenser 320. In the embodiment illustrated in FIG. 3, the second temperature sensor 380 is positioned proximate an exit of the second heat transfer fluid path 324 of the condenser 320, but the second temperature sensor 380 may be positioned at any suitable location, for example and without limitation, proximate an inlet of the second heat transfer fluid path 324 of the condenser 320, or within the second heat transfer fluid path 324 itself. The first and second temperature sensors 360, 380 may be thermocouples, thermistors, resistance temperature detectors (RTDs), or any other suitable type of temperature sensor.

Figure 4:
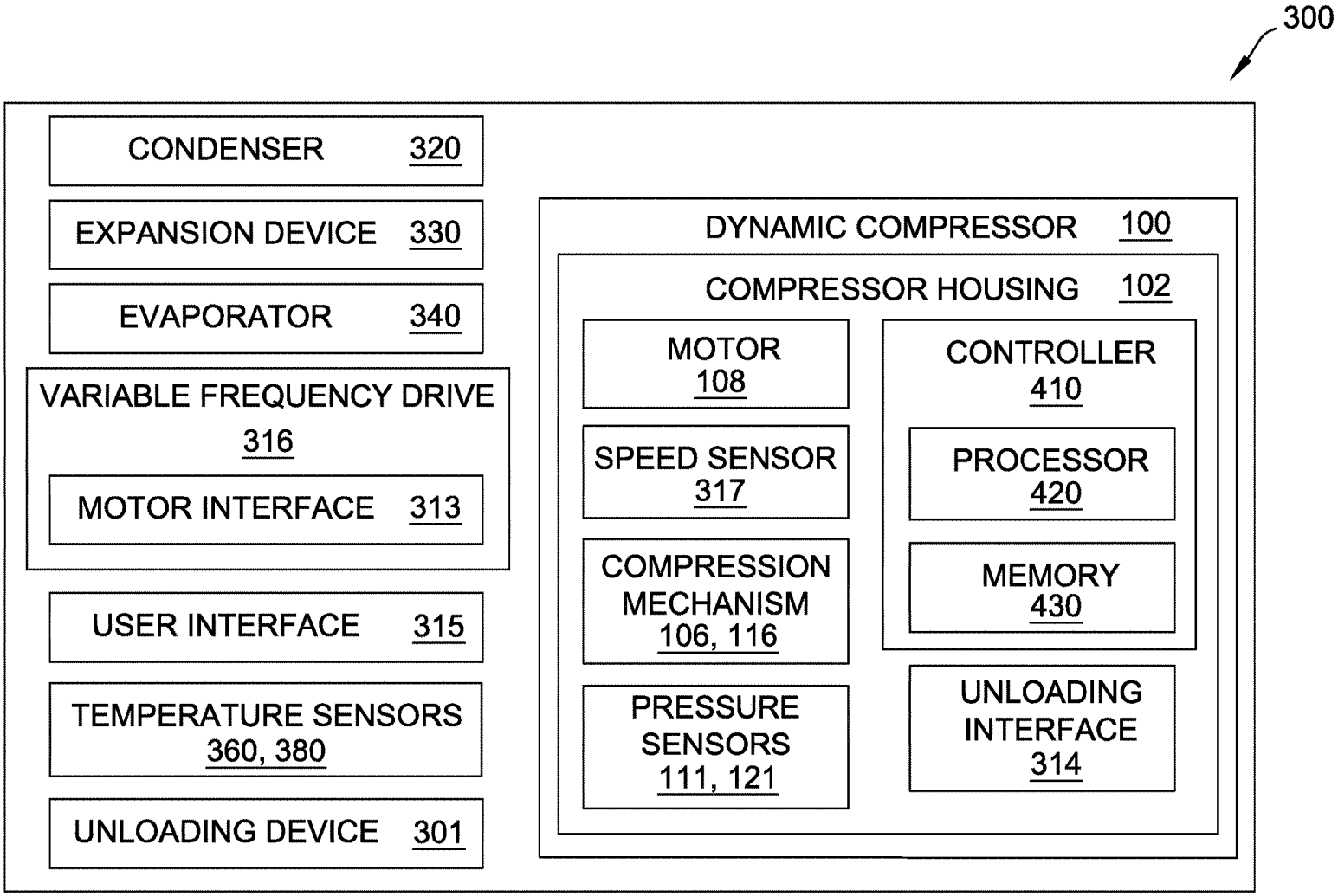
FIG. 4 is a block diagram of a control system for the dynamic compressor shown in FIGS. 1 and 2.

FIG. 4 shows an example embodiment of the system 300 including the dynamic compressor 100. The compressor 100 includes a compressor housing 102, at least one compression mechanism 106, 116, a motor 108, a speed sensor 317, pressure sensors 111, 121 and a controller 410. In the present embodiment, the dynamic compressor 100 is a two-stage centrifugal compressor, and the compression mechanism includes the first compression mechanism 106 and the second compression mechanism 116, each of which may be an impeller. In other embodiments, the dynamic compressor 100 may be an axial compressor, and each of the first and second compression mechanisms 106, 116 may be an axial rotor. The speed sensor 317 measures the rotational speed of the dynamic compressor 100, and the pressure sensors 111, 121 respectively measure the pressure at the first refrigerant inlet 110 and the second refrigerant exit 120, as shown in FIG. 3. The dynamic compressor 100 may include additional pressure sensors for measuring pressure at various points along the compressor flow path. Additional sensors may be installed in the compressor 100 to provide data on its operation, including but not limited to temperature sensors, flow sensors, current sensors, voltage sensors, rotational rate sensors, and any other suitable sensors. The dynamic compressor 100 is not limited to a specific construction in the system 300 and may be constructed similarly to the dynamic compressor 100 described with respect to FIGS. 1 and 2 or may be constructed in a different manner. The system 300 further includes an unloading device 301, a variable frequency drive (VFD) 316, and a user interface 315.

A controller 410 is operatively connected to the dynamic compressor 100 to control its operation, based at least in part on the measured parameters described above. The controller 410 includes a processor 420 and a memory 430. The memory 430 stores a map 700 (see, e.g., FIG. 7) of a plurality of predetermined operating points 50 of the dynamic compressor 100 which can be stored in any suitable data structure, such as a table, a matrix, or the like. The memory 430 additionally stores instructions that program the processor 420 to determine a start-up pressure ratio PR of the dynamic compressor 100. The map 700 of predetermined operating points 50 and a method 600 of determining the startup pressure ratio PR of the dynamic compressor 100 are discussed in greater detail further below.

The system 300 includes an interface for connection of the controller 410 to the VFD 316 and a motor interface 313 for connection of the VFD 316 to the motor 108. In certain embodiments, the VFD 316 operates under the control of the controller 410. In further embodiments, the VFD 316 is a part of the controller 410. The system 300 further includes an unloading interface 314 for connection of the controller 410 to the unloading device 301.

The controller 410 is operatively coupled to the unloading device 301 through the unloading interface 314, which removes and/or reduces the load on the dynamic compressor 100 during start-up and shut-down routines, during detected surge events, and when otherwise instructed by the controller 410 to do so. In the example embodiment, the unloading device 301 is a variable inlet guide vane (VIGV) at the inlet of each impeller stage (FIG. 2). In other embodiments, the unloading device 301 may be a variable diffuser or a bypass valve. The controller 410 is configured to control at least one operating parameter of the unloading device 301, such as a position of each VIGV.

The system 300 further includes a user interface 315 configured to output (e.g., display) and/or receive information (e.g., from a user) associated with the system 300. In some embodiments, the user interface 315 is configured to receive an activation and/or deactivation input from a user to activate and deactivate (i.e., turn on and off) or otherwise enable operation of the system 300. Moreover, in some embodiments, the user interface 315 is configured to output information associated with one or more operational characteristics of the system 300, including, for example and without limitation, warning indicators such as severity alerts, occurrence alerts, fault alerts, motor speed alerts, and any other suitable information.

The user interface 315 may include any suitable input devices and output devices that enable the user interface 315 to function as described herein. For example, the user interface 315 may include input devices including, but not limited to, a keyboard, mouse, touchscreen, joystick(s), throttle(s), buttons, switches, and/or other input devices. Moreover, the user interface 315 may include output devices including, for example and without limitation, a display (e.g., a liquid crystal display (LCD) or an organic light emitting diode (OLED) display), speakers, indicator lights, instruments, and/or other output devices. Furthermore, the user interface 315 may be part of a different component, such as a system controller (not shown). Other embodiments do not include a user interface 315.

The controller 410 is generally configured to control operation of the dynamic compressor 100. The controller 410 controls operation through programming and instructions from another device or controller or is integrated with the system 300 through a system controller. In some embodiments, for example, the controller 410 receives user input from the user interface 315, and controls one or more components of the system 300 in response to such user inputs. For example, the controller 410 may control the motor 108 based on user input received from the user interface 315. In some embodiments, the system 300 may be controlled by a remote control interface. For example, the system 300 may include a communication interface (not shown) configured for connection to a wireless control interface that enables remote control and activation of the system 300. The wireless control interface may be embodied on a portable computing device, such as a tablet or smartphone.

The controller 410 may generally include any suitable computer and/or other processing unit, including any suitable combination of computers, processing units and/or the like that may be communicatively coupled to one another and that may be operated independently or in connection within one another (e.g., controller 410 may form all or part of a controller network). Controller 410 may include one or more modules or devices, one or more of which is enclosed within system 300, or may be located remote from system 300. The controller 410 may be part of the dynamic compressor 100 or separate and may be part of a system controller in an HVAC system. Controller 410 and/or components of controller 410 may be integrated or incorporated within other components of system 300. The controller 410 may include one or more processor(s) 420 and associated memory device(s) 430 configured to perform a variety of computer-implemented functions (e.g., performing the calculations, determinations, and functions disclosed herein).

As used herein, the term "processor" refers not only to integrated circuits, but also to a controller, a microcontroller, a microcomputer, a programmable logic controller (PLC), an application-specific integrated circuit, and other programmable circuits. Additionally, memory device(s) 430 of controller 410 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 430 may generally be configured to store suitable computer-readable instructions that, when implemented by the processor(s) 420, configure or cause the controller 410 to perform various functions described herein including, but not limited to, controlling the system 300, controlling operation of the motor 108, receiving inputs from user interface 315, providing output to an operator via user interface 315, controlling the unloading device 301 and/or various other suitable computer-implemented functions.

Figure 5:
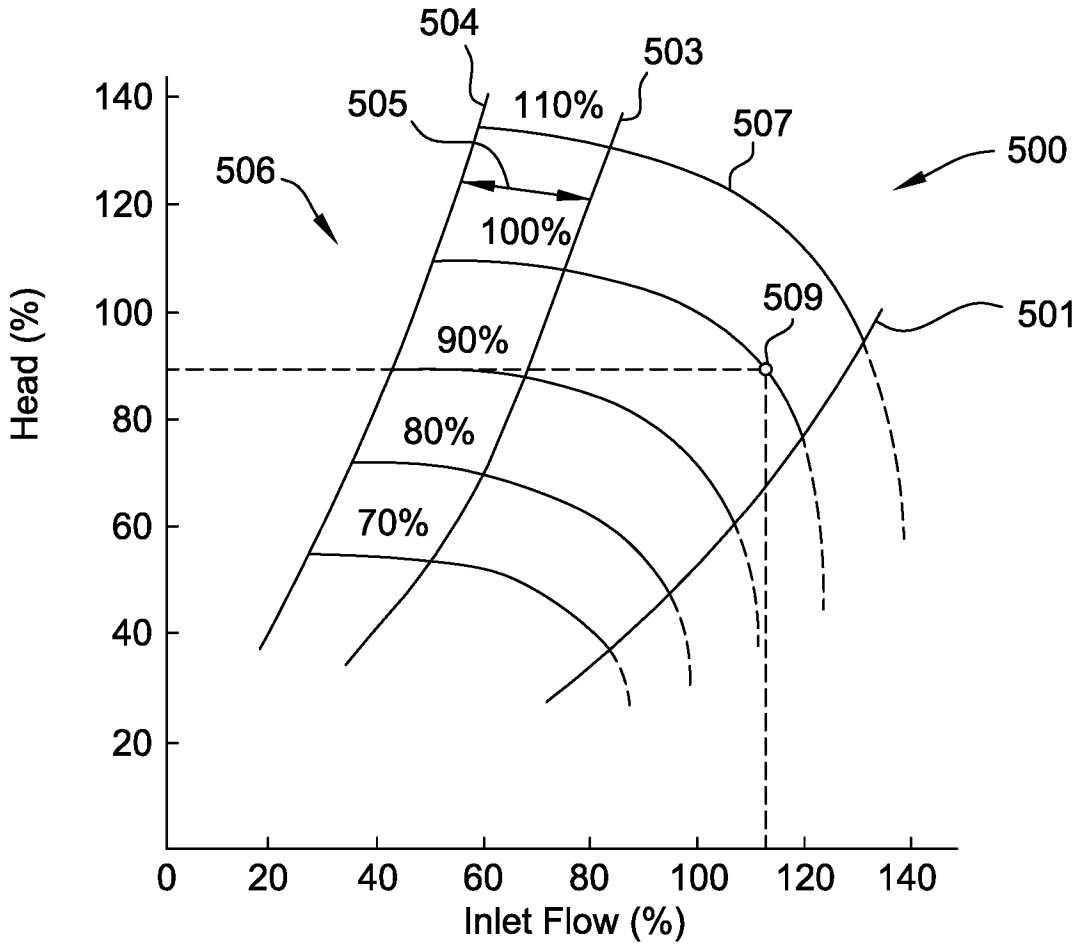
FIG. 5 is an operating map of the dynamic compressor shown in FIGS. 1 and 2.

Referring to FIG. 5, an operating envelope or operating map 500 of the example dynamic centrifugal compressor 100 is shown. The operating map 500 graphically displays a compressor's performance in terms of flows, heads, and speeds. The operating map 500 shows head vs. inlet mass flow rate as a percentage of their values at the design point of the dynamic compressor 100. The head is a total pressure ratio of exit pressure to inlet pressure. Inlet mass flow rate is a measure of the amount of a working fluid, such as a refrigerant, flowing through the compression mechanisms 106, 116. The operating map 500 shows a plurality of compressor speed lines 507. In this example, there are five speed lines 507 that range from 70% design speed to 110% design speed, with each line separated by a 10% difference. Although these particular speed lines are shown in this example, any number of speed lines at any different percentages of the compressor design speed may be shown for any type of compressor.

A surge limit line 504 indicates the minimum flow before surge occurs in the surge region 506 (i.e., to the left of surge limit line 504). A surge control line 503 roughly indicates the minimum flow under which the compressor 100 can safely operate without risk of slipping into surge. The surge control line 503 is defined by a surge margin 505 from the surge limit line 504. By operating to the right of the surge control line 503, the dynamic compressor 100 should avoid surging. Similarly, the choke line 501 indicates that operation to its right will result in the dynamic compressor 100 operating with choked flow.

A first operating point 509 of the dynamic compressor 100 is shown on the operating map 500 as the intersection of a speed line, inlet mass flow rate value, and pressure ratio value. For example, the first operating point 509 shown in operating map 500 is at 112% inlet mass flow rate, 90% head, and 100% speed, though any number of operating points may be shown for any type of compressor. The operating point defines the current operating parameters of the dynamic compressor 100, and the operating map 500 indicates how close the current operating point is to operating in an unstable condition (i.e., surge) or an inefficient condition (i.e., choke).

Figure 6:
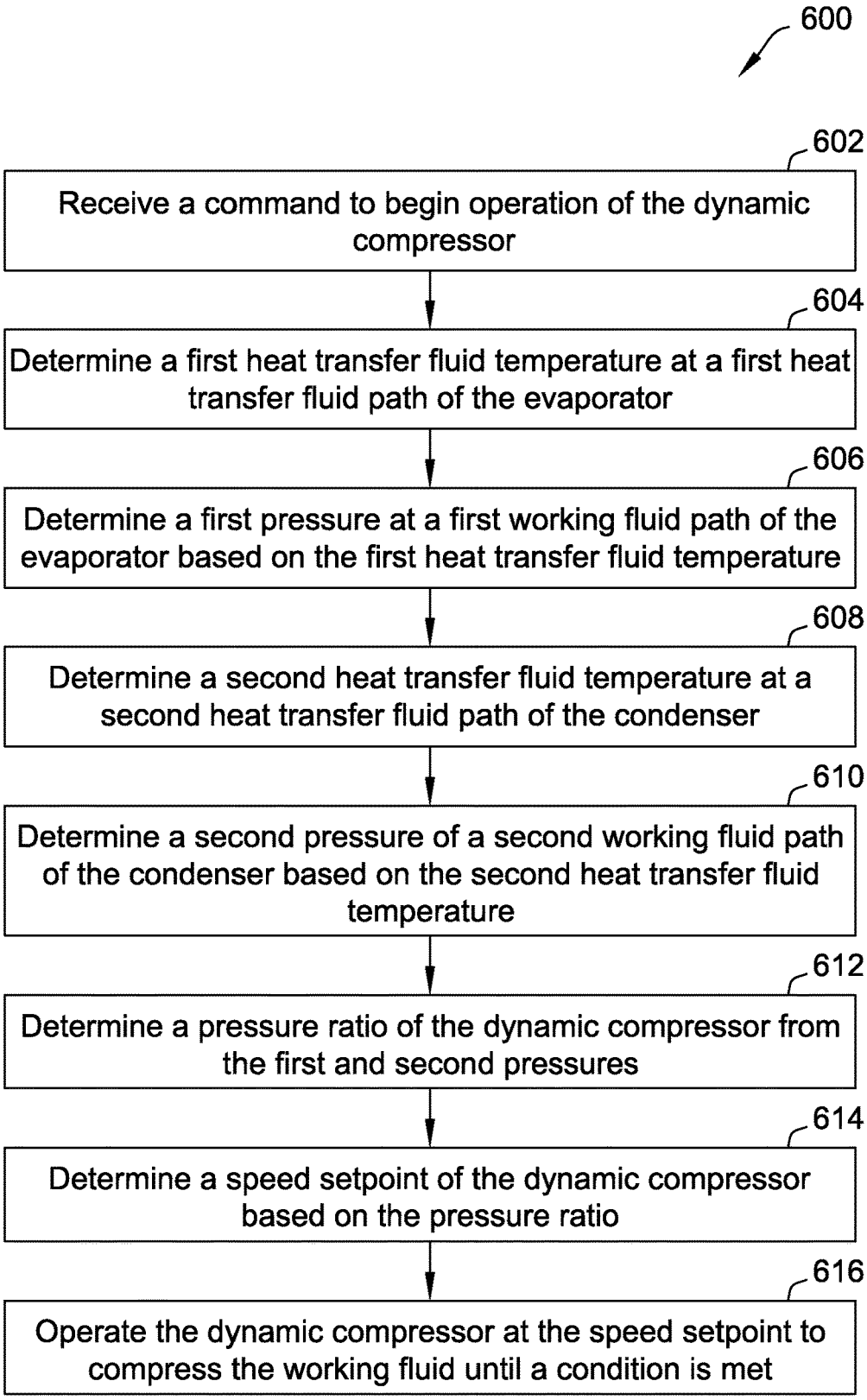
FIG. 6 is a method of determining a start-up pressure ratio of the dynamic compressor shown in FIGS. 1 and 2.

The memory 430 stores instructions that program the processor 420 to determine a start-up pressure ratio PR of the dynamic compressor 100. An example method 600 is shown in FIG. 6. The processor 420 receives 602 a command to begin operation of the dynamic compressor 100. In some embodiments, the command may be initiated by a user, by an automated command, or by any other suitable means. The processor 420 is further programmed to determine 604 a first heat transfer fluid temperature $T_{1,htf}$ at the first heat transfer fluid path 344 of the evaporator 340 and determine 608 a second heat transfer fluid temperature $T_{2,htf}$ at the second heat transfer fluid path 324 of the condenser 320. In some embodiments, determining 604 the first heat transfer fluid temperature $T_{1,htf}$ comprises receiving the first heat transfer fluid temperature $T_{1,htf}$ from the first temperature sensor 360, and determining 608 the second heat transfer fluid temperature $T_{2,htf}$ comprises receiving the second heat transfer fluid temperature $T_{2,htf}$ from the second temperature sensor 380.

The processor 420 is additionally programmed to determine 606 a first pressure $P_1$ at the first working fluid path 342 of the evaporator 340 based on the first heat transfer fluid temperature $T_{1,htf}$, and to determine 610 a second pressure $P_2$ at the second working fluid path 322 of the condenser 320 based on the second heat transfer fluid temperature $T_{2,htf}$. In some embodiments, determining the first and second pressures $P_1$, $P_2$ based on the first and second heat transfer fluid temperatures $T_{1,htf}$, $T_{2,htf}$ includes determining a first or second working fluid saturation temperature $T_{1,wf}$, $T_{2,wf}$ based on the first or second heat transfer fluid temperature $T_{1,htf}$, $T_{2,htf}$, and calculating the first or second pressure $P_1$, $P_2$ as a function of the first or second working fluid saturation temperature $T_{1,wf}$, $T_{2,wf}$ using an empirical equation of the working fluid. For example, in embodiments in which the refrigerant is R134a, refrigerant pressure P can be calculated as a function of working fluid saturation temperature $T_{wf}$ using the formula:

$$P=0.01165\cdot T_{wf}^2-0.12869\cdot T_{wf}+35.63$$

In some embodiments, the first and second working fluid saturation temperatures $T_{1,wf}$, $T_{2,wf}$ are estimated based on other system parameters. Such embodiments will be discussed in greater detail further below.

In further embodiments, determining the first pressure $P_1$ includes receiving a first pressure value corresponding to the first working fluid saturation temperature $T_{1,wf}$ from a data table for the working fluid stored in the memory, and determining the second pressure $P_2$ includes retrieving a second pressure value corresponding to the second working fluid saturation temperature $T_{2,wf}$ from the data table for the working fluid. The data table may include experimental data, simulated data, or any other suitable type of data.

The processor 420 is further programmed to determine 612 the pressure ratio PR of the dynamic compressor 100 from the first and second pressures $P_1$, $P_2$. In some embodiments, the pressure ratio PR is determined by calculating an estimated pressure ratio $PR_{est}$ as the second pressure $P_2$ divided by the first pressure $P_1$:

$$PR_{est} = \frac{P_2}{P_1}$$

The processor 420 is then programmed to determine 614 a speed setpoint $N_{set}$ of the dynamic compressor 100 based on the pressure ratio PR. With reference to FIG. 5, the speed setpoint $N_{set}$ may be selected such that the operating point of the dynamic compressor 100 falls between the surge control line 503 and the choke line 501 to avoid operation at an unstable or inefficient condition. For example, the processor 420 may determine a surge speed $N_{surge}$ and a choke speed $N_{choke}$ corresponding to the pressure ratio PR, and determine that the speed setpoint $N_{set}$ is a value between the surge speed $N_{surge}$ and the choke speed $N_{choke}$. In some embodiments, the speed setpoint $N_{set}$ may be calculated as:

$$N_{set}=N_{surge}+k\cdot(N_{choke}-N_{surge})$$

where k is a scaling factor between zero and one. In some embodiments, k may be 0.5 such that the speed setpoint $N_{set}$ is exactly halfway between the surge speed $N_{surge}$ and the choke speed $N_{choke}$. In further embodiments, k may be less than 0.5, such that the speed setpoint $N_{set}$ is closer to the surge speed $N_{surge}$ than to the choke speed $N_{choke}$. In still further embodiments, k may be greater than 0.5, such that the speed setpoint $N_{set}$ is closer to the choke speed $N_{choke}$ than to the surge speed $N_{surge}$.

Figure 7:
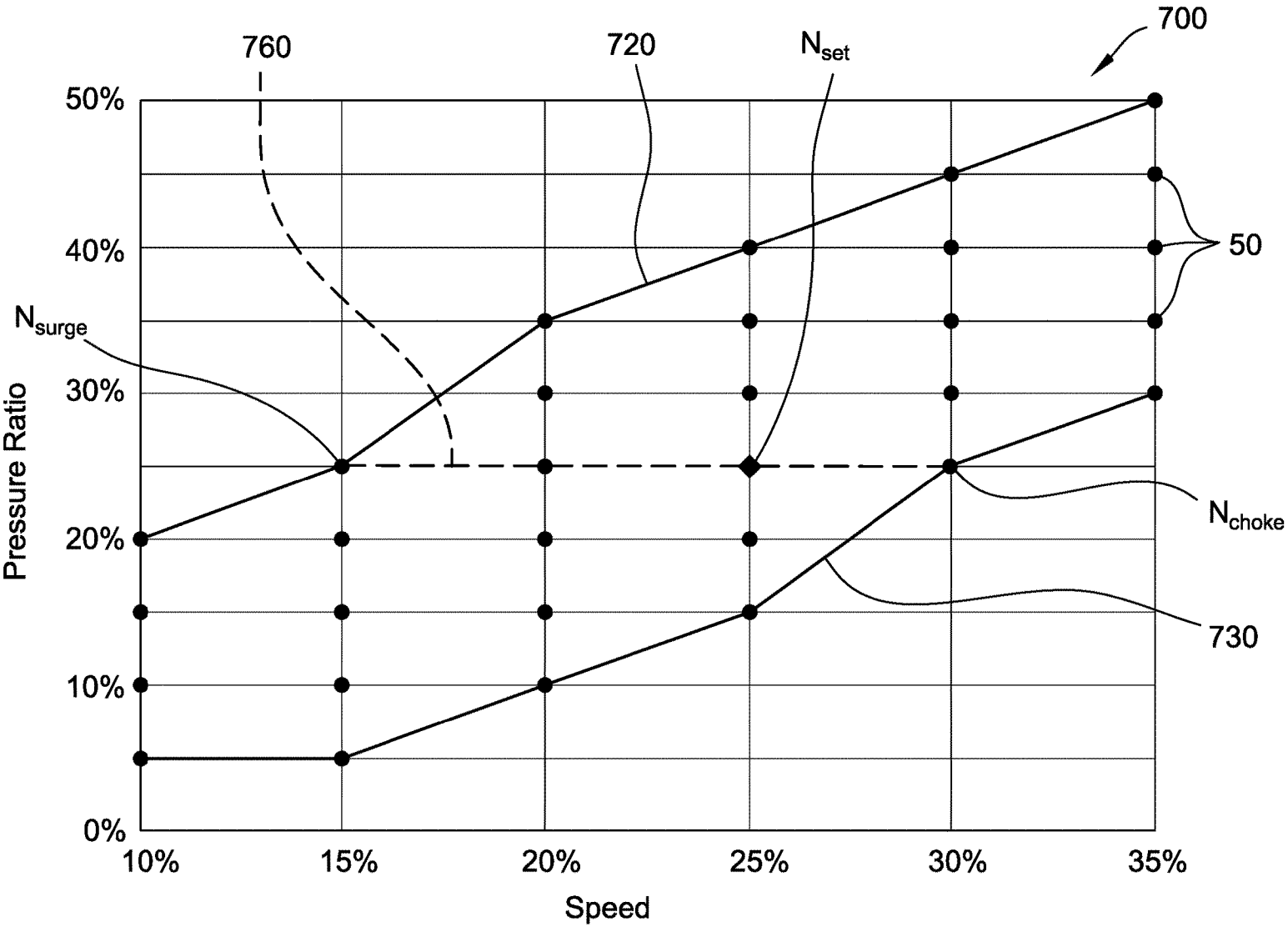
FIG. 7 is a map of predetermined operating points of the dynamic compressor shown in FIGS. 1 and 2.

In some embodiments, the processor 420 may determine the surge speed $N_{surge}$ and the choke speed $N_{choke}$ corresponding to the pressure ratio PR using the map 700 of predetermined operating points 50 stored in the memory 430. For example, FIG. 7 is a representative illustration of a map 700 of predetermined operating points 50 stored by the memory 430. Each predetermined operating point 50 is shown as the intersection of a compressor speed value and a compressor pressure ratio value. An inlet mass flow rate is also defined for each predetermined operating point 50. The map 700 includes predetermined operating points 50 in a range up to and including points along the machine surge line 720 and the machine choke line 730. The map 700 does not include any points above the surge line 720 or below the choke line 730, because points above the surge line 720 or below the choke line 730 are to be avoided and are thus not "operating points." In other embodiments, predetermined operating points above the surge line 720 or below the choke line 730 may be included.

In the map 700, the predetermined operating points 50 range between 10% and 35% speed, and between 5% and 50% pressure ratio, with each point separated by 5% on both axes. Although these particular predetermined operating points 50 are shown in this example, any number of operating points at any values and with any resolution may be shown for any type of compressor. The speed, pressure ratio, inlet mass flow rate, and VIGV position values of each predetermined operating point 50 may be generated by simulating operation of the dynamic compressor 100 on a computer, testing the dynamic compressor 100 in a controlled environment, a combination of simulation and testing, or by any other suitable method for predetermining the speed, pressure ratio, inlet mass flow rate, and VIGV position values of each predetermined operating point 50.

The predetermined operating points 50 retrieved from the map 700 may themselves indicate the choke speed or the surge speed of dynamic compressor 100 at the start-up pressure ratio PR. For example, at the start-up pressure ratio PR=25% head, the surge speed $N_{surge}$ is 15% design speed, and the choke speed $N_{choke}$ is 30% design speed. The scaling factor k may be selected such that the speed setpoint $N_{set}$ falls on the dashed line 760 between the surge speed $N_{surge}$ and the choke speed $N_{choke}$. For example, k may be selected such that the speed setpoint $N_{set}$ is at 25% design speed, as shown in FIG. 7. In further embodiments, the predetermined operating points 50 retrieved from the map 700 may be used to graphically or numerically determine the choke speed or surge speed at the start-up pressure ratio PR, for example, by interpolation. In further embodiments, the predetermined operating points 50 closest to the surge speed and choke speed may be retrieved.

The processor 420 is further programmed to operate 616 the dynamic compressor 100 at the speed setpoint $N_{set}$ to compress the working fluid until a condition is met. In some embodiments, the processor 420 operates 616 the dynamic compressor 100 at the speed setpoint $N_{set}$ until a predetermined startup time expires. The predetermined startup time may be, for example and without limitation, 1 minute, 2 minutes, or any other suitable duration. In further embodiments, the processor 420 is further programmed to determine a measured pressure ratio $PR_{meas}$ of the dynamic compressor 100 and operate the dynamic compressor 100 at the speed setpoint $N_{set}$ until the measured pressure ratio $PR_{meas}$ exceeds the estimated pressure ratio $PR_{est}$.

The measured pressure ratio $PR_{meas}$ may be calculated using measured pressure values. For example, the memory 430 may store instructions that program the processor 420 to receive a value of a first measured pressure $P_{1,meas}$ of the working fluid upstream of the dynamic compressor 100. The first measured pressure $P_{1,meas}$ may be obtained from the inlet pressure sensor 111 disposed proximate the first refrigerant inlet 110. Similarly, the memory 430 may store additional instructions that program the processor 420 to receive a value of a second measured pressure $P_{2,meas}$ of the working fluid downstream of the dynamic compressor 100. The second measured pressure $P_{2,meas}$ may be obtained from the exit pressure sensor 121 disposed proximate the second refrigerant exit 120.

In such embodiments, the memory 430 stores further instructions that program the processor 420 to determine a measured pressure ratio $PR_{meas}$ based on the first and second measured pressures $P_{1,meas}$, $P_{2,meas}$. The measured pressure ratio $PR_{meas}$ may be calculated as the second measured pressure $P_{2,meas}$ divided by the first pressure $P_{1,meas}$:

$$PR_{meas} = \frac{P_{2,meas}}{P_{1,meas}}$$

In further embodiments, the processor 420 is programmed to operate 616 the dynamic compressor 100 at the speed setpoint $N_{set}$ to compress the working fluid until a first to occur of the measured pressure ratio $PR_{meas}$ exceeding the estimated pressure ratio $PR_{est}$ or the predetermined start-up time expiring.

Figure 8A:
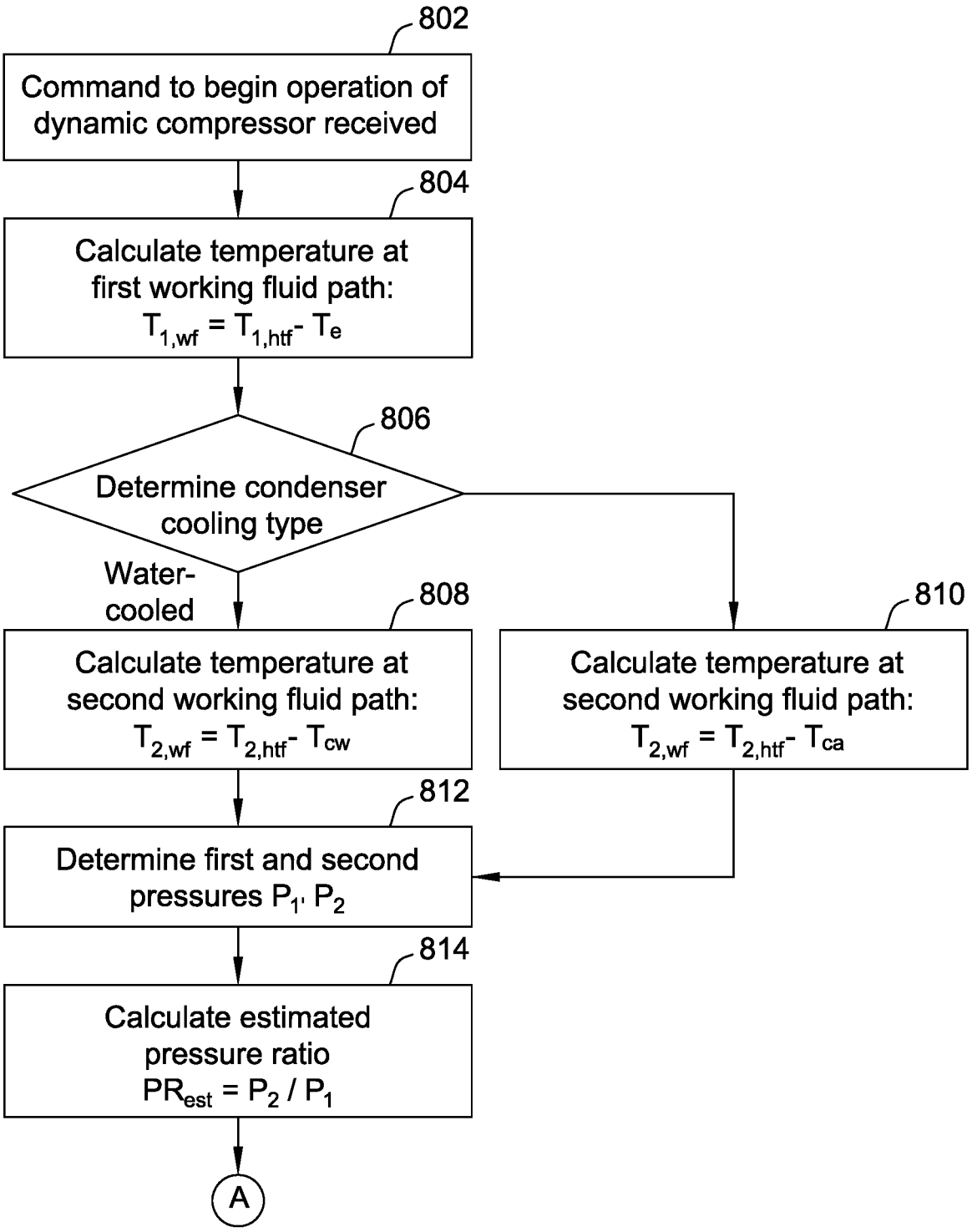
FIG. 8A is a first part of a flow chart of an example control algorithm for performing a start-up routine of the dynamic compressor shown in FIGS. 1 and 2.
Figure 8B:
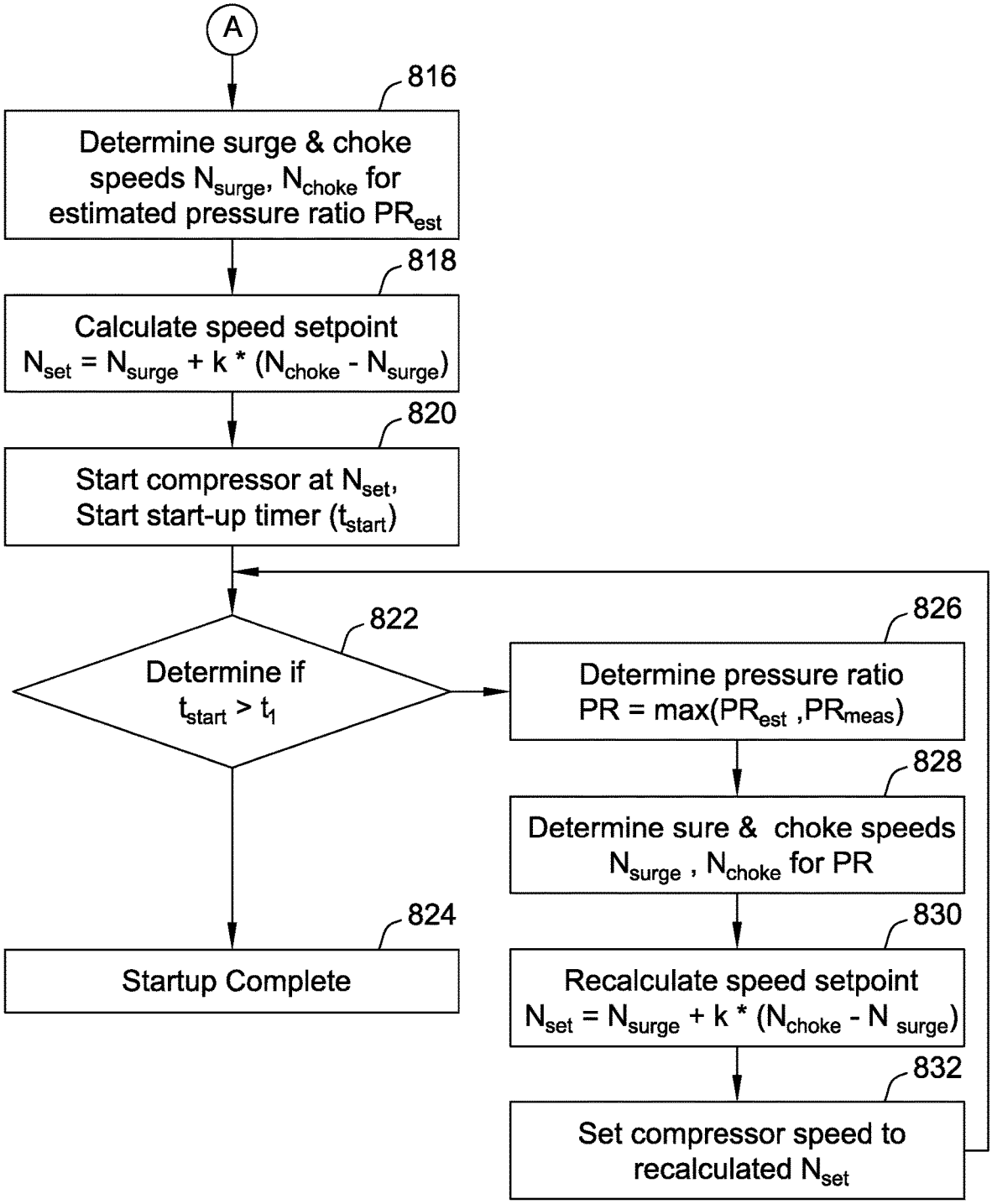
FIG. 8B is a second part of the flow chart shown in FIG. 8A.

FIGS. 8A and 8B (collectively FIG. 8) show an example control algorithm 800 for calculating the start-up pressure ratio PR of the dynamic compressor according to the method 600. After receiving 802 the command to begin operation of the dynamic compressor 100, the processor 420 calculates 804 the first working fluid saturation temperature $T_{1,wf}$ at the first working fluid path 342 of the evaporator 340. In the illustrated embodiment, the first working fluid saturation temperature $T_{1,wf}$ at the first working fluid path 342 is calculated as the difference between the first heat transfer fluid temperature $T_{1,htf}$ measured at the first heat transfer fluid path 344 and a first temperature offset $T_e$:

$$T_{1,wf}=T_{1,htf}-T_e$$

The first temperature offset $T_e$ accounts for the difference in temperature between the saturated refrigerant in the first working fluid path 342 and the heat transfer fluid exiting the first heat transfer fluid path 344. The first temperature offset $T_e$ may be, for example and without limitation, 5 degrees F., 10 degrees F., or any other suitable temperature offset.

Similarly, a temperature offset may also be added to the second heat transfer fluid temperature $T_{2,htf}$ measured at the second heat transfer fluid path 324 of the condenser 320 to account for the difference in temperature between the saturated refrigerant in the second working fluid path 322 and the heat transfer fluid exiting the second heat transfer fluid path 324. In the example control algorithm 800 shown in FIG. 8, the processor 420 determines 806 what type of heat transfer fluid is used in the second heat transfer fluid path 324 of the condenser 320 and calculates 808, 810 the second working fluid saturation temperature $T_{2,wf}$ at the second working fluid path 322 accordingly. If the processor 420 determines that the heat transfer fluid is water, the second working fluid saturation temperature $T_{2,wf}$ at the second working fluid path 322 may be calculated 808 as the sum of the second heat transfer fluid temperature $T_{2,htf}$ measured at the second heat transfer fluid path 324 and a second temperature offset $T_{cw}$:

$$T_{2,wf}=T_{2,htf}+T_{cw}$$

The second temperature offset $T_{cw}$ may be, for example and without limitation, 5 degrees F., 10 degrees F., 20 degrees F., or any other suitable temperature offset. If the processor 420 determines that the heat transfer fluid is air, the second working fluid saturation temperature $T_{2,wf}$ at the second working fluid path 322 may be calculated 810 as the sum of the second heat transfer fluid temperature $T_{2,htf}$ measured at the second heat transfer fluid path 324 and a second temperature offset $T_{ca}$:

$$T_{2,wf}=T_{2,htf}+T_{ca}$$

The second predetermined temperature offset $T_{ca}$ may be, for example and without limitation, 10 degrees F., 20 degrees F., or any other suitable temperature offset.

In the example control algorithm 800 shown in FIG. 8, the processor 420 is further programmed to determine 812 the first and second pressures $P_1$, $P_2$ based on the first and second working fluid saturation temperatures $T_{1,wf}$, $T_{2,wf}$ and calculate 814 the estimated pressure ratio $PR_{est}$ as the second pressure $P_2$ divided by the first pressure $P_1$. The processor 420 then determines 816 the surge and choke speeds $N_{surge}$, $N_{choke}$ of the dynamic compressor 100 at the estimated pressure ratio $PR_{est}$ and calculates 818 the speed setpoint $N_{set}$ of the dynamic compressor 100 as a value between the surge and choke speeds $N_{surge}$, $N_{choke}$.

The processor 420 is then programmed to start 820 the dynamic compressor 100 at the speed setpoint $N_{set}$ and start a start-up timer. The start-up timer may measure a start-up time $t_{start}$ indicating the duration of time that has passed since operation of the dynamic compressor 100 began. The processor 420 determines 822 if the start-up time $t_{start}$ has reached a start-up completion time $t_1$, and if so, also determines 824 that start-up is complete, and begins to operate the dynamic compressor 100 based on the measured pressure ratio $PR_{meas}$. In the illustrated embodiment, the start-up completion time $t_1$ is 1 minute, but the start-up completion time $t_1$ may be any suitable duration of time, for example and without limitation, 30 seconds, 90 seconds, or two minutes. If the processor 420 determines 822 that the start-up time $t_{start}$ has not yet reached the start-up completion time $t_1$, the processor 420 also determines 826 which of the estimated pressure ratio $PR_{est}$ or the measured pressure ratio $PR_{meas}$ is greater. The processor 420 then determines 828 the surge and choke speeds $N_{surge}$, $N_{choke}$ corresponding to the greater of the two pressure ratios $PR_{est}$, $PR_{meas}$, and recalculates 830 the speed setpoint $N_{set}$ of the dynamic compressor 100 as a value between the surge and choke speeds $N_{surge}$, $N_{choke}$. The processor 420 sets 832 the speed of the dynamic compressor 100 to the recalculated speed setpoint $N_{set}$, and the processor 420 once again determines 822 if the start-up time $t_{start}$ has reached the start-up completion time $t_1$, and proceeds with the following steps described above.

Technical benefits of the systems described herein are as follows: (1) existing system instrumentation may be used to determine a safe operating envelope for a dynamic compressor during its start-up routine, (2) compressor reliability may be improved by limiting the time the compressor spends outside of the safe operating envelope.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A system comprising:

an evaporator having a first working fluid path and a first heat transfer fluid path thermally coupled thereto;

a condenser having a second working fluid path and a second heat transfer fluid path thermally coupled thereto;

a dynamic compressor fluidly coupled to the first working fluid path of the evaporator and the second working fluid path of the condenser, the dynamic compressor operable to compress a working fluid;

a first temperature sensor positioned within the first heat transfer fluid path of the evaporator;

a second temperature sensor positioned within the second heat transfer fluid path of the condenser;

a controller connected to the dynamic compressor, the controller comprising a processor and a memory, the memory storing instructions that program the processor to:

receive a command to begin operation of the dynamic compressor;

receive a first heat transfer fluid temperature from the first temperature sensor;

determine a first pressure at the first working fluid path of the evaporator based on the first heat transfer fluid temperature;

receive a second heat transfer fluid temperature from the second temperature sensor;

determine a second pressure at the second working fluid path of the condenser based on the second heat transfer fluid temperature;

determine an estimated pressure ratio of the dynamic compressor from the first and second pressures;

receive a value of a first measured pressure of the working fluid upstream of the dynamic compressor;

receive a value of a second measured pressure of the working fluid downstream of the dynamic compressor;

determine a measured pressure ratio based on the first and second measured pressures;

determine a speed setpoint of the dynamic compressor based on the estimated pressure ratio; and operate the dynamic compressor at the speed setpoint to compress the working fluid until a condition is met.

2. The system of claim 1, wherein operating the dynamic compressor at the speed setpoint until a condition is met comprises operating the dynamic compressor at the speed setpoint until a predetermined start-up time expires.

3. The system of claim 1, wherein determining the first pressure comprises:

determining a first working fluid saturation temperature at the first working fluid path of the evaporator based on the first heat transfer fluid temperature; and calculating the first pressure as a function of the first working fluid saturation temperature using an empirical equation of the working fluid; and wherein determining the second pressure comprises:

determining a second working fluid saturation temperature at the second working fluid path of the condenser based on the second heat transfer fluid temperature; and calculating the second pressure as a function of the second working fluid saturation temperature using the empirical equation of the working fluid.

4. The system of claim 1, wherein determining the first pressure comprises:

determining a first working fluid saturation temperature at the first working fluid path of the evaporator based on the first heat transfer fluid temperature; and retrieving a first pressure value corresponding to the first working fluid saturation temperature from a data table for the working fluid stored in the memory, and wherein determining the second pressure comprises:

determining a second working saturation fluid temperature at the second working fluid path of the condenser based on the second heat transfer fluid temperature; and retrieving a second pressure value corresponding to the second working fluid saturation temperature from the data table for the working fluid.

5. The system of claim 1, wherein determining the estimated pressure ratio comprises calculating the estimated pressure ratio as the second pressure divided by the first pressure.

6. The system of claim 1, wherein operating the dynamic compressor at the speed setpoint until the condition is met comprises operating the dynamic compressor at the speed setpoint until the measured pressure ratio exceeds the estimated pressure ratio.

7. The system of claim 1, wherein operating the dynamic compressor at the speed setpoint comprises operating the dynamic compressor at the speed setpoint until a first to occur of the measured pressure ratio exceeding the estimated pressure ratio or until a predetermined start-up time expiring.

8. The system of claim 1, wherein determining the speed setpoint of the dynamic compressor comprises:

determining a surge speed corresponding to the estimated pressure ratio;

determining a choke speed corresponding to the estimated pressure ratio; and determining that the speed setpoint is a value between the surge speed and the choke speed.

9. The system of claim 1, wherein the dynamic compressor is a centrifugal compressor.

10. A controller for a system, the system comprising an evaporator, a condenser, and a dynamic compressor fluidly coupled therebetween, the controller comprising:

a processor; and a memory, the memory storing instructions that program the processor to:

receive a command to begin operation of the dynamic compressor;

determine a first heat transfer fluid temperature at a first heat transfer fluid path of the evaporator;

determine a first pressure at a first working fluid path of the evaporator based on the first heat transfer fluid temperature;

determine a second heat transfer fluid temperature at a second heat transfer fluid path of the condenser;

determine a second pressure at a second working fluid path of the condenser based on the second heat transfer fluid temperature;

calculate an estimated pressure ratio of the dynamic compressor from the first and second pressures;

receive a value of a first measured pressure of the working fluid upstream of the dynamic compressor;

receive a value of a second measured pressure of the working fluid downstream of the dynamic compressor;

determine a measured pressure ratio based on the first and second measured pressures;

determine a speed setpoint of the dynamic compressor based on the estimated pressure ratio; and operate the dynamic compressor at the speed setpoint to compress a working fluid until a condition is met.

11. The controller of claim 10, wherein determining the first heat transfer fluid temperature comprises receiving the first heat transfer fluid temperature from a first temperature sensor at the first heat transfer fluid path of the evaporator, and wherein determining the second heat transfer fluid temperature comprises receiving the second heat transfer fluid temperature from a second temperature sensor at the second heat transfer fluid path of the condenser.

12. The controller of claim 10, wherein determining the first pressure comprises:

determining a first working fluid saturation temperature at the first working fluid path of the evaporator based on the first heat transfer fluid temperature; and calculating the first pressure as a function of the first working fluid saturation temperature using an empirical equation of the working fluid; and wherein determining the second pressure comprises:

determining a second working fluid saturation temperature at the second working fluid path of the condenser based on the second heat transfer fluid temperature; and calculating the second pressure as a function of the second working fluid saturation temperature using the empirical equation of the working fluid.

13. The controller of claim 12, wherein determining the first working fluid saturation temperature comprises subtracting a first temperature offset from the first heat transfer fluid temperature, and wherein determining the second working fluid saturation temperature comprises adding a second temperature offset to the second heat transfer fluid temperature.

14. The controller of claim 10, wherein determining the first pressure comprises:

determining a first working fluid saturation temperature at a first working fluid path of the evaporator based on the first heat transfer fluid temperature; and receiving a first pressure value corresponding to the first working fluid saturation temperature from a data table for the working fluid stored in the memory, and wherein determining the second pressure comprises:

determining a second working fluid saturation temperature at the second working fluid path of the condenser based on the second heat transfer fluid temperature; and receiving a second pressure value corresponding to the second working fluid saturation temperature from the data table for the working fluid.

15. The controller of claim 10, wherein determining the estimated pressure ratio comprises calculating the estimated pressure ratio as the second pressure divided by the first pressure.

16. The controller of claim 10, wherein operating the dynamic compressor at the speed setpoint until the condition is met comprises operating the dynamic compressor at the speed setpoint until the measured pressure ratio exceeds the estimated pressure ratio.

17. The controller of claim 10, wherein operating the dynamic compressor at the speed setpoint comprises operating the dynamic compressor at the speed setpoint until a first to occur of the measured pressure ratio exceeding the estimated pressure ratio or a predetermined start-up time expiring.

18. The controller of claim 10, wherein determining the speed setpoint of the dynamic compressor comprises:

determining a surge speed corresponding to the estimated pressure ratio;

determining a choke speed corresponding to the estimated pressure ratio; and determining that the speed setpoint is a value between the surge speed and the choke speed.

* * * * *